US011885559B2

(12) United States Patent
Kim et al.

(10) Patent No.: US 11,885,559 B2
(45) **Date of Patent: *Jan. 30, 2024**

(54) REFRIGERATOR

(71) Applicant: SAMSUNG ELECTRONICS CO., LTD., Suwon-si (KR)

(72) Inventors: Hyun Joo Kim, Suwon-si (KR); Yong Man Seo, Suwon-si (KR); In-Sung Hwang, Suwon-si (KR); Bok Hyun Jang, Suwon-si (KR); Tae Youl Lee, Suwon-si (KR); Jeong Won Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/900,286

(22) Filed: Aug. 31, 2022

(65) Prior Publication Data

US 2022/0412647 A1 Dec. 29, 2022

Related U.S. Application Data

(63) Continuation of application No. 17/238,988, filed on Apr. 23, 2021, now Pat. No. 11,460,243, which is a (Continued)

(30) Foreign Application Priority Data

Jul. 8, 2015 (KR) ..... 10-2015-0097318

(51) Int. Cl.
*F25D 23/02* (2006.01)
*F25D 29/00* (2006.01)

(52) U.S. Cl.
CPC ..... *F25D 29/005* (2013.01); *F25D 23/02* (2013.01); *F25D 23/025* (2013.01); (Continued)

(58) Field of Classification Search
CPC ..... F25D 29/005; F25D 23/02; F25D 23/028; F25D 23/04; F25D 23/00; F25D 23/025; (Continued)

(56) References Cited

U.S. PATENT DOCUMENTS 4,706,794 A 11/1987 Awane
4,834,231 A 5/1989 Awane
(Continued)

FOREIGN PATENT DOCUMENTS

CN 1384326 A 12/2002
CN 201455962 U 5/2010
(Continued)

OTHER PUBLICATIONS

Supplementary European Search Report dated Jun. 26, 2018 in European Patent Application No. 16821570.5.
(Continued)

*Primary Examiner* — Hiwot E Tefera
(74) *Attorney, Agent, or Firm* — STAAS & HALSEY LLP

(57) ABSTRACT

A refrigerator may include a storage compartment, an inner door which comprises an opening having a size corresponding to a size of the storage compartment, a plurality of door guards, and an outer door which open and close the storage compartment, wherein the inner door comprises a control unit may control an internal environment of the storage compartment.

8 Claims, 11 Drawing Sheets

Related U.S. Application Data continuation of application No. 16/569,259, filed on Sep. 12, 2019, now Pat. No. 11,022,368, which is a continuation of application No. 16/202,711, filed on Nov. 28, 2018, now Pat. No. 10,451,342, which is a continuation of application No. 15/204,530, filed on Jul. 7, 2016, now Pat. No. 10,174,994.

(52) U.S. Cl.
CPC .... *F25D 2323/023* (2013.01); *F25D 2400/06* (2013.01); *F25D 2400/361* (2013.01)

(58) Field of Classification Search
CPC .. F25D 2323/023; F25D 13/04; F25D 17/045; F25D 2400/361; F25D 2700/12; F25D 29/00; F25D 17/145; F25D 11/02; F25D 2317/062; F25D 2400/36; F25D 2400/06
USPC ..... 312/404, 405, 405.1, 291, 292
See application file for complete search history.

(56) References Cited

U.S. PATENT DOCUMENTS

| | | | | |
|---|---|---|---|---|
| 4,966,004 | A | 10/1990 | Midlang | |
| 5,442,933 | A | 8/1995 | Unger | |
| 6,067,738 | A | 5/2000 | Zeligson | |
| 6,483,695 | B1 | 11/2002 | Hartstein | |
| 7,878,009 | B2 | 2/2011 | Doberstein | |
| 8,960,934 | B2 | 2/2015 | Sung | |
| 9,510,696 | B2 | 12/2016 | Lee | |
| 9,518,777 | B2 | 12/2016 | Lee | |
| 9,972,284 | B2 | 5/2018 | Lee | |
| 10,174,994 | B2 | 1/2019 | Kim et al. | |
| 11,022,368 | B2 | 6/2021 | Kim et al. | |
| 11,460,243 | B2 * | 10/2022 | Kim | F25D 23/02 |
| 2001/0035024 | A1 | 11/2001 | Dasher | |
| 2006/0150661 | A1 | 7/2006 | Kim et al. | |
| 2008/0059003 | A1 | 3/2008 | Doberstein | |
| 2008/0168794 | A1 * | 7/2008 | Cho | F25D 25/025 62/449 |
| 2008/0231159 | A1 | 9/2008 | Lee | |
| 2008/0297019 | A1 * | 12/2008 | Kim | F25D 23/02 312/405 |
| 2009/0284157 | A1 | 11/2009 | Wetekamp | |
| 2010/0319390 | A1 | 12/2010 | Lee | |
| 2011/0314849 | A1 | 12/2011 | Park | |
| 2012/0286638 | A1 | 11/2012 | Lee | |
| 2013/0119849 | A1 | 5/2013 | Gwak | |
| 2013/0285528 | A1 | 10/2013 | Park | |
| 2013/0327075 | A1 | 12/2013 | Kim | |
| 2013/0342095 | A1 | 12/2013 | Choo | |
| 2014/0132143 | A1 | 5/2014 | Kim | |
| 2014/0145580 | A1 | 5/2014 | Lee | |
| 2014/0203695 | A1 | 7/2014 | Oh | |
| 2014/0232251 | A1 | 8/2014 | Kim | |
| 2014/0246970 | A1 | 9/2014 | Park et al. | |
| 2015/0040604 | A1 | 2/2015 | You et al. | |
| 2015/0052920 | A1 | 2/2015 | Park et al. | |
| 2015/0247668 | A1 | 9/2015 | Willis | |
| 2015/0260445 | A1 | 9/2015 | Kim | |
| 2016/0282035 | A1 | 9/2016 | Sul | |

FOREIGN PATENT DOCUMENTS

| | | | |
|---|---|---|---|
| CN | 202582007 | U | 12/2012 |
| CN | 203654382 | U | 6/2014 |
| EP | 2 131 123 | A2 | 12/2009 |
| EP | 2 131 123 | A3 | 5/2010 |
| EP | 2 730 869 | A2 | 5/2014 |
| EP | 3 169 958 | B1 | 7/2019 |
| KR | 10-2011-0089535 | A | 8/2011 |
| KR | 10-2011-0089788 | | 8/2011 |
| KR | 10-2012-0063316 | | 6/2012 |
| KR | 10-2013-0072186 | | 7/2013 |
| KR | 10-2014-0060431 | | 5/2014 |
| KR | 10-2014-0102511 | | 8/2014 |
| KR | 10-2014-0104638 | | 8/2014 |
| KR | 10-2014-0131759 | | 11/2014 |
| WO | WO 2006/098591 | A1 | 9/2006 |

OTHER PUBLICATIONS

European Office Action dated Jul. 17, 2018 in corresponding European Patent Application No. 16 821 570.5.
International Search Report dated Sep. 12, 2016 in corresponding International Patent Application No. PCT/KR2016/006949.
Notice of Allowability dated Sep. 27, 2018 in related U.S. Appl. No. 15/204,530.
Notice ofAllowance dated Aug. 28, 2018 in related U.S. Appl. No. 15/204,530.
Office Action dated May 3, 2018 in related U.S. Appl. No. 15/204,530.
Advisory Action dated March 30, 2018 in related U.S. Appl. No. 15/204,530.
Office Action dated Jan. 26, 2018 in related U.S. Appl. No. 15/204,530.
Office Action dated Jun. 29, 2017 in related U.S. Appl. No. 15/204,530.
Office Action dated Apr. 13, 2017 in related U.S. Appl. No. 15/204,530.
Office Action dated Feb. 21, 2019 in related U.S. Appl. No. 16/202,711.
Notice of Allowance dated Jun. 14, 2019 in related U.S. Appl. No. 16/202,711.
Chinese Patent Office Action issued in Chinese Patent Application No. 201680036949.4 dated Oct. 8, 2019.
Korean Patent Office Action issued in Korean Patent Application No. 10-2015-0097318 dated Sep. 19, 2019.
Chinese Office Action dated May 15, 2020, in corresponding Chinese Patent Application No. 201680036949.4.
Korean Office Action dated Dec. 3, 2020, in corresponding Korean Patent Application No. 10-2020-0040163.
Chinese Office Action dated Dec. 17, 2020, in corresponding Chinese Patent Application No. 201680036949.4.
Communication pursuant to Article 94(3) EPC dated Mar. 3, 2021, in corresponding European Patent Application No. 16 821 570.5
Office Action dated Feb. 6, 2020 in related U.S. Appl. No. 16/569,259.
Office Action dated May 28, 2020 in related U.S. Appl. No. 16/569,259.
Office Action dated Oct. 26, 2020 in related U.S. Appl. No. 16/569,259.
Notice of Allowance dated Jan. 29, 2021 in related U.S. Appl. No. 16/569,259.
Supplemental Notice of Allowance dated Mar. 16, 2021 in related U.S. Appl. No. 16/569,259.
Corrected Notice of Allowance dated Apr. 29, 2021 in related U.S. Appl. No. 16/569,259.
Australian Office Action dated May 4, 2021, in corresponding Australian Patent Application No. 2016291014 in English.
Korean Notice of Allowance dated Jun. 9, 2021, in corresponding Korean Patent Application No. 10-2020-0040163.
Office Action dated Nov. 23, 2021, issued in Korean Patent Application No. 10-2021-0120119.
Office Action dated May 19, 2022, issued in Korean Application No. 10-2021-0120119.
Office Action dated May 24, 2022, issued in Chinese Application No. 201680036949.4.
Office Action dated Jul. 25, 2022, issued in Chinese Application No. 201680036949.4.
Office Action dated Jan. 28, 2022, issued in U.S. Appl. No. 17/238,988.
Notice of Allowance dated Jun. 7, 2022, issued in U.S. Appl. No. 17/238,988.
Interview Summary dated May 27, 2022, in U.S. Appl. No. 17/238,988.
U.S. Appl. No. 17/238,988, filed Apr. 23, 2021, Hyun Joo Kim et al, Samsung Electronics Co., Ltd.

(56) References Cited

OTHER PUBLICATIONS

U.S. Appl. No. 16/569,259, filed Sep. 12, 2019, Hyun Joo Kim et al, Samsung Electronics Co., Ltd.
U.S. Appl. No. 16/202,711, filed Nov. 28, 2018, Hyun Joo Kim et al, Samsung Electronics Co., Ltd.
U.S. Appl. No. 15/204,530, filed Jul. 7, 2016, Hyun Joo Kim et al, Samsung Electronics Co., Ltd.
European Search Report dated Jan. 18, 2023, in European Application No. EP 22 20 5526.
Office Action dated Nov. 29, 2022, in Korean Application No. 10-2022-0103505.
Office Action dated Nov. 23, 2023, in Korean Application No. 10-2023-0124772.

* cited by examiner

REFRIGERATOR

CROSS-REFERENCE TO RELATED APPLICATION

This application is a continuation of U.S. patent application Ser. No. 17/238,988, filed Apr. 23, 2021, which is a continuation of U.S. patent application Ser. No. 16/569,259, filed Sep. 12, 2019, issued as U.S. Pat. No. 11,022,368, which is a continuation of U.S. patent application Ser. No. 16/202,711, filed Nov. 28, 2018, issued as U.S. Pat. No. 10,451,342, which is a continuation of U.S. patent application Ser. No. 15/204,530, filed Jul. 7, 2016, issued as U.S. Pat. No. 10,174,994, and claims benefit of foreign priority to Korean Patent Application No. 10-2015-0097318, filed on Jul. 8, 2015 in the Korean Intellectual Property Office, the disclosures of which are incorporated herein by reference.

BACKGROUND

1. Field

Embodiments of the present disclosure relate to a refrigerator including an inner door including an opening and an outer door which opens and closes the opening.

2. Description of the Related Art

Generally, refrigerators are home appliances which each include a storage compartment for storing food and a cool air supply device to keep food fresh for a long time.

A rack is provided in the storage compartment to put food thereon. The storage compartment may be provided to allow a front side thereof to be opened to put food in or take food out, and the open front side of the storage compartment may be opened and closed by a main door pivotably coupled with the a body. A door guard capable of storing food in addition to the rack disposed in the storage compartment may be provided on a rear side of the main door.

Since the door guard described above is provided at the rear side of the main door, generally, it is possible to approach the door guard by opening the main door. Meanwhile, there are refrigerators which include an additional auxiliary door provided at the main door in order to approach the door guard without opening the main door. In the case of refrigerators including the auxiliary door described above, since it is possible to approach the door guard provided at the rear side of the main door by opening only the auxiliary door, a diversity of food-storing options may increase and an effect of preserving cool air may be provided.

SUMMARY

Therefore, it is an aspect of the present disclosure to provide a refrigerator in which a control unit which controls an internal environment of a storage compartment of the refrigerator is installed at a main door and it is possible to approach the control unit provided at the main door by opening an auxiliary door and a method of manufacturing the refrigerator.

Additional aspects of the present disclosure will be set forth in part in the description which follows and, in part, will be obvious from the description, or may be learned by practice of the present disclosure.

In accordance with one aspect of the present disclosure, a refrigerator may include a body, a storage compartment formed in the body, an inner door which comprises an opening corresponding to the storage compartment and is pivotably coupled with the body, an outer door disposed to be relatively pivotable from the inner door, and a control unit configured to control an internal environment of the storage compartment. A mounting portion on which the control unit is mounted may be provided at the inner door. The control unit may be mounted on the mounting portion.

The control unit may include an operational portion and a display portion.

The control unit may be configured to control a temperature, humidity, smell, lighting, etc. of the storage compartment.

The control unit may include a circuit board which comprises an operational portion and a display portion, and a cover which covers the circuit board and comprises an opening which exposes a button portion operating on the operational portion and the display portion.

The control unit may include a housing which accommodates the circuit board and the cover and is coupled with the mounting portion of the inner door.

The control unit may include a transparent member which covers the cover and on which a function of the button portion is displayed.

The inner door may include an upper frame, a lower frame, a left frame, and a right frame which form the opening. The control unit may be disposed on at least one of the upper frame, the lower frame, the left frame, and the right frame.

The inner door may include an inner panel, an outer panel forming an interposing space with the inner panel, and an insulator foamed in the space. The control unit may be disposed between the inner panel and the outer panel.

The refrigerator may further include a plurality of door guards provided at the inner door. The inner panel may include an inner wall which forms the opening and supports the plurality of door guards.

The plurality of door guards each may include a front wall, a rear wall, both side walls, a bottom, and a storage space.

The front wall of each of the plurality of door guards may form a part of a front side of the inner door.

The outer door may include a transparent window provided for checking the control unit from the outside.

The outer door may include a transparent or translucent material for checking the control unit from the outside.

In accordance with another aspect of the present disclosure, a refrigerator may include a body, at least one storage compartment formed in the body, a plurality of doors which open and close the at least one storage compartment, and a control unit configured to control an internal environment of the at least one storage compartment. The plurality of doors may include a first door formed of a single door and a second door formed of a dual door. The control unit may be disposed at the second door.

The second door may include an inner door which include an opening corresponding to the at least one storage compartment, an inner panel, and an outer panel with a space formed between the inner panel and the outer panel, and an insulator foamed in the space and is pivotably coupled with the body, and an outer door coupled to be relatively pivotable with respect to the inner door to open and close the opening. A mounting portion on which the control unit is mounted may be provided at the outer panel of the inner door. The control unit may be disposed in the space between the inner panel and the outer panel.

The outer door of the second door may include a transparent window provided for checking the control unit mounted on the inner door with the outer door closed.

The outer door of the second door may include a transparent or translucent material for checking the control unit mounted on the inner door with the outer door closed.

In accordance with one aspect of the present disclosure, a method of manufacturing an dual door of a refrigerator, which includes a body, a storage compartment formed in the body, the dual door pivotably coupled with the body for dually opening and closing the storage compartment, and a control unit configured for controlling an internal environment of the storage compartment, may include disposing the control unit at the dual door, injecting a bubble solution into an inner space of the dual door at which the control unit is disposed, and strongly coupling the control unit with the dual door by foaming the bubble solution.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Hereinafter, exemplary embodiments of the present disclosure will be described in detail.

Figure 1:
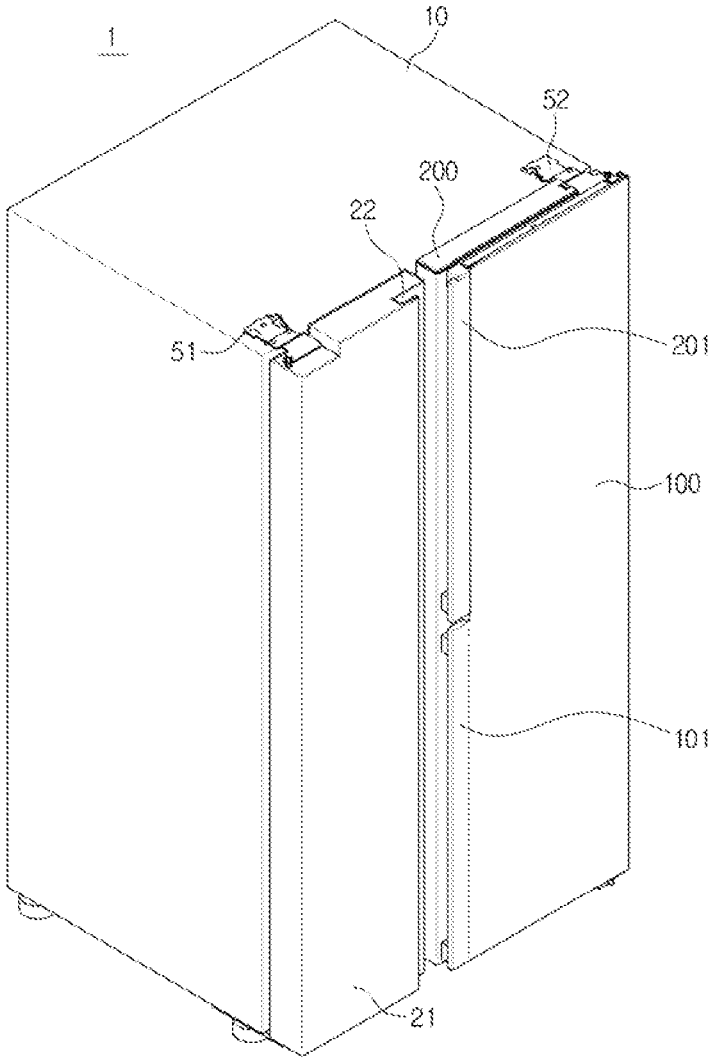
FIG. 1 is a view of a refrigerator in accordance with one embodiment of the present disclosure in a state with both an inner door and an outer door closed.
Figure 2:
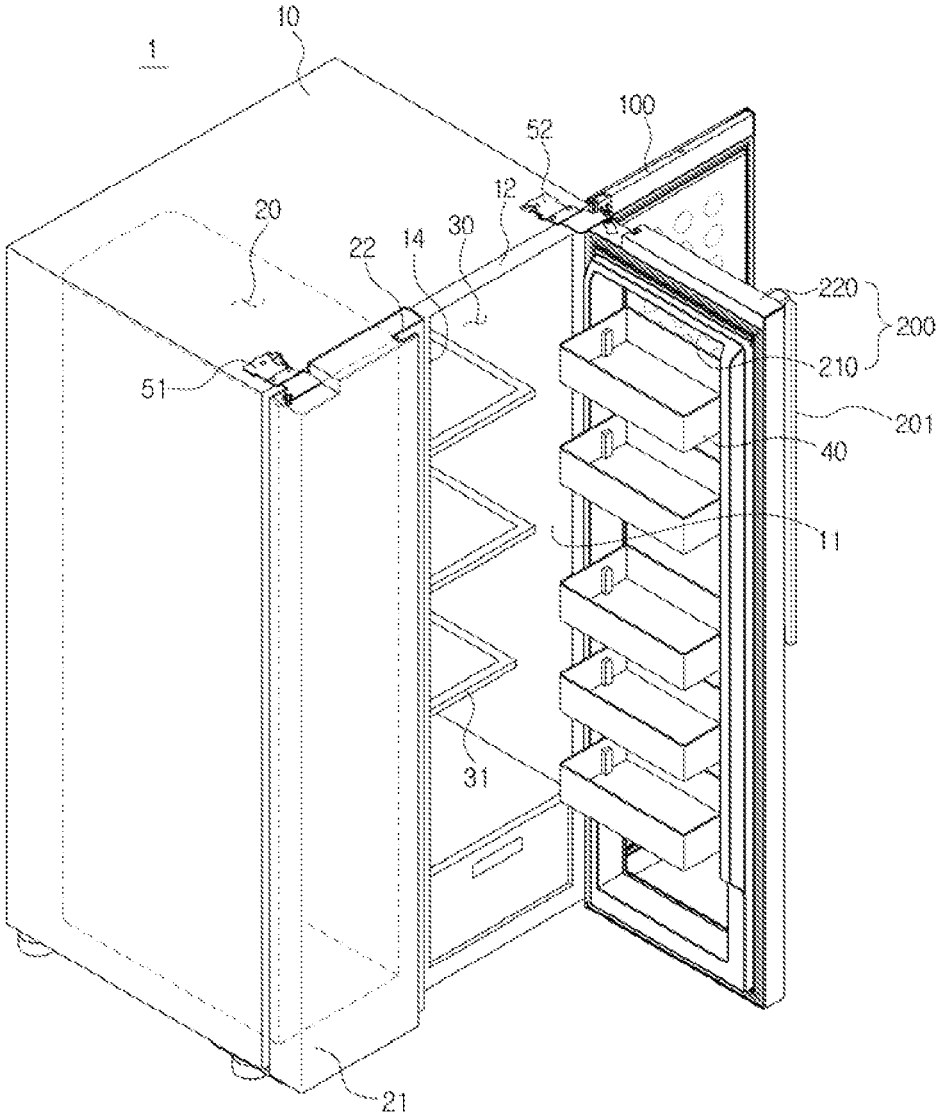
FIG. 2 is a view illustrating a state with the inner door and the outer door of the refrigerator of FIG. 1 separately opened.
Figure 3:
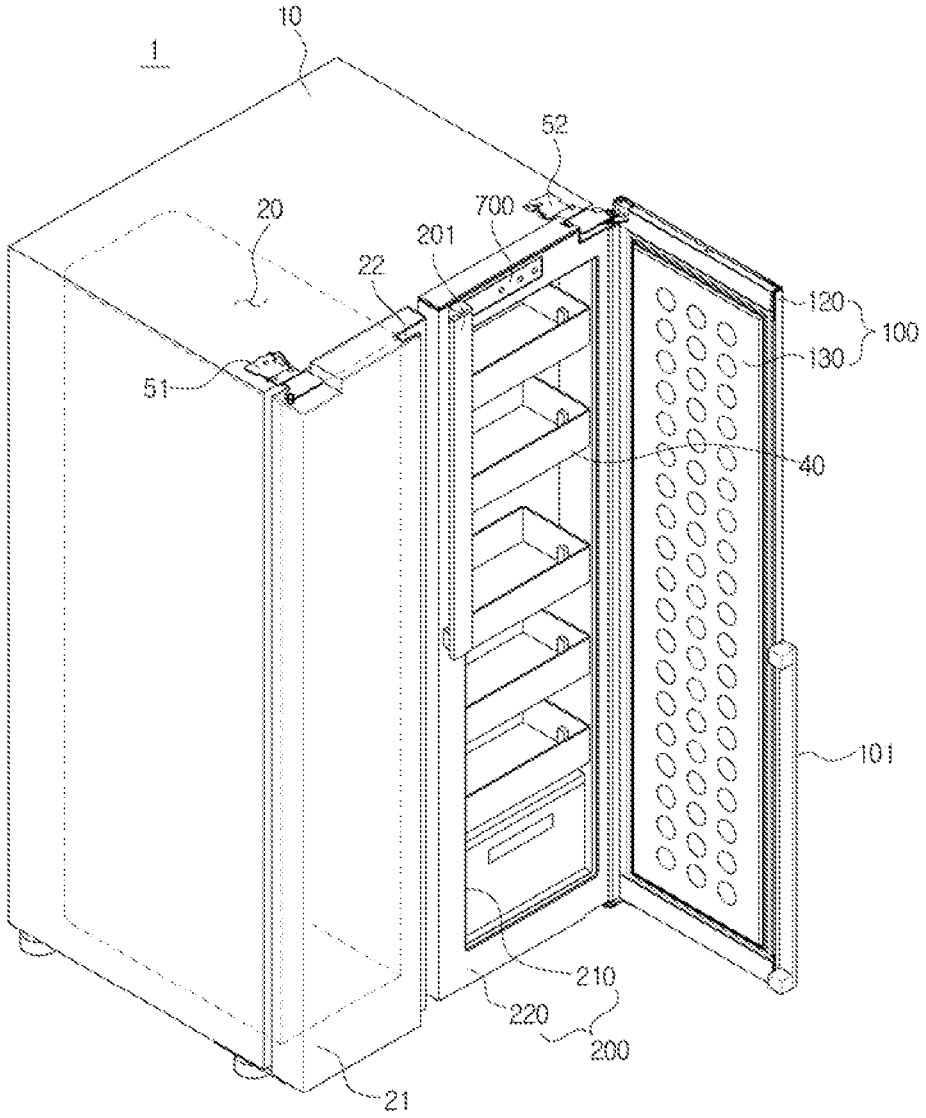
FIG. 3 is a view illustrating a state in which only the outer door of the refrigerator of FIG. 1 is opened.
Figure 4:
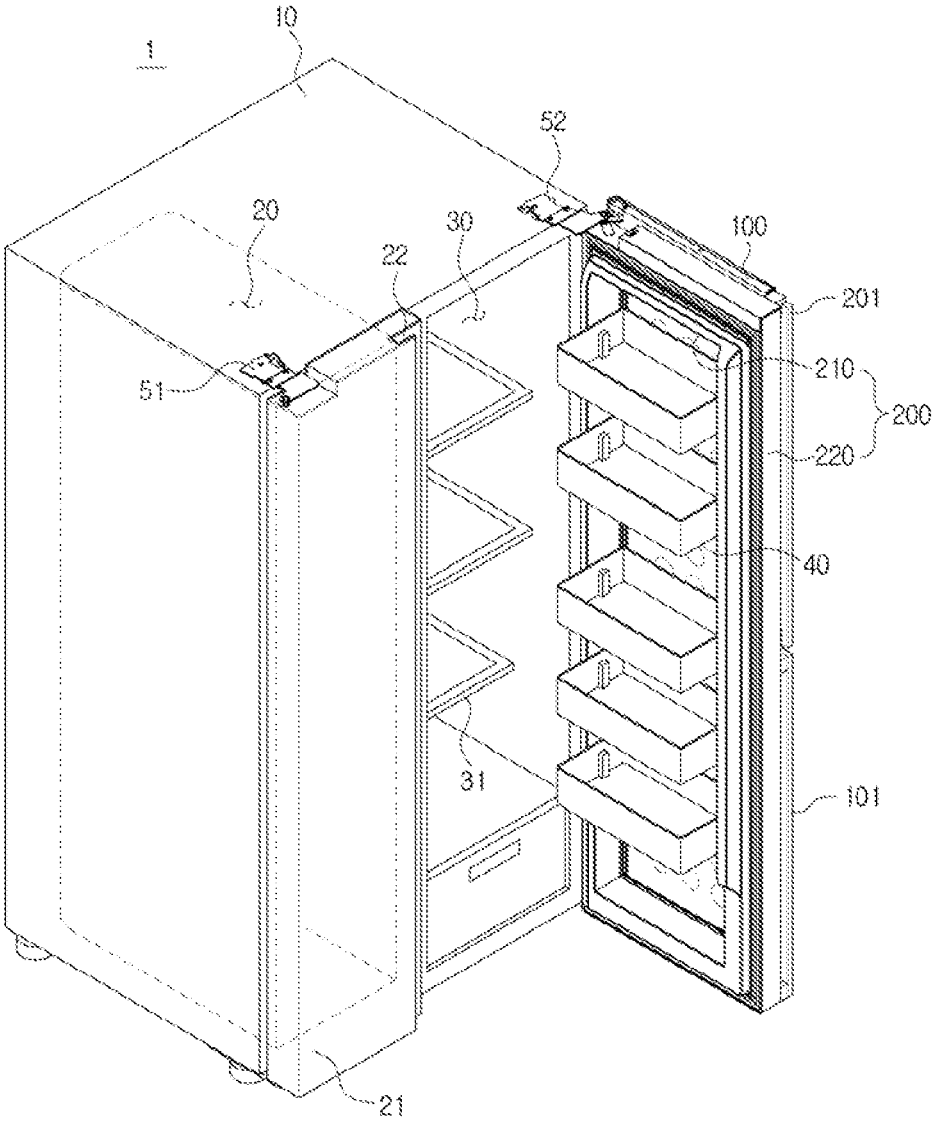
FIG. 4 is a view illustrating a state with the inner door of the refrigerator of FIG. 1 is opened.

FIG. 1 is a view of a refrigerator in accordance with one embodiment of the present disclosure in a state with both an inner door and an outer door closed, FIG. 2 is a view illustrating a state with the inner door and the outer door of the refrigerator of FIG. 1 separately opened, FIG. 3 is a view illustrating a state in which only the outer door of the refrigerator of FIG. 1 is opened, and FIG. 4 is a view illustrating a state with the inner door of the refrigerator of FIG. 1 is opened.

Referring to FIGS. 1 to 4, a refrigerator 1 in accordance with the embodiment of the present disclosure includes a body 10, storage compartments 20 and 30 provided inside the body 10, and a cool air supply device which supplies cool air to the storage compartments 20 and 30.

The body 10 includes an inner casing 11 which has an approximately box shape and forms the storage compartments 20 and 30, an outer casing 12 which is coupled with an outside of the inner casing 11 and forms an exterior, and an insulator provided between the inner casing 11 and the outer casing 12. The inner casing 11 may be formed of a resin material, and the outer casing 12 may be formed of a metal material.

The cool air supply device may include a compressor (not shown), a condenser (not shown), an expansion valve (not shown), and an evaporator (not shown) and may generate cool air using evaporating latent heat.

The storage compartments 20 and 30 may be divided into a freezing compartment 20 on the left and a refrigerating compartment 30 on the right by an intermediate wall 14. However, positions of the freezing compartment 20 and the refrigerating compartment 30 are changeable. Racks 31 on which food may be put are provided in the refrigerating compartment 30.

The freezing compartment 20 and the refrigerating compartment 30 may each have an open front side to allow putting food in or taking food out. The open front side of the freezing compartment 20 may be opened and closed by a freezing compartment door 21, and the open front side of the refrigerating compartment 30 may be opened and closed by a dual door formed of an outer door 100 and an inner door 200. As shown in the drawings, the freezing compartment door 21 is formed as a single door but may also be formed as a dual door.

The freezing compartment door 21 may be pivotably coupled with the body 10 by an upper hinge member 51 and a lower hinge member (not shown). The outer door 100 and the inner door 200 may also be pivotably coupled with the body 10 by an upper hinge member 52 and a lower hinge member (not shown). Particularly, the outer door 100 may be disposed to be relatively pivotable with respect to the inner door 200.

Here, although not shown in the drawings in detail, the outer door 100 and the inner door 200 may have different rotation axes or may share a single rotation axis.

The freezing compartment door 21, the outer door 100, and the inner door 200 may include handles 22, 101, and 201, respectively.

Meanwhile, the inner door 200 includes an opening 210 having a size approximately corresponding to a size of the refrigerating compartment 30 and a door frame 220 which forms the opening 210. Accordingly, the door frame 220 may have an approximately quadrangular frame shape.

The opening 210 includes a plurality of door guards 40 (which may also be referred to as a door bins) capable of storing food. The door guards 40 may generally store low-profile and small food items or food items which is frequently put in or taken out. The plurality of door guards 40 may be arranged in a row in a vertical direction at the opening 210.

A control unit 700 capable of controlling internal environments of the storage compartments 20 and 30 is disposed at the inner door 200. The control unit 700 may include a display portion 712 which displays environment information including temperature, humidity, smell, illuminance, etc. in the storage compartments 20 and 30 and an operational portion 711 for controlling temperature and humidity, deodorization, and setting illuminance, power saving, operation-locking, etc.

Although not shown in the drawings, the control unit 700 may be disposed in the freezing compartment door 21 formed of a single door. The outer door 100 does not include an opening and may have an approximately flat panel shape. Accordingly, the outer door 100 may open and close the opening 210 of the inner door 200.

Considering an operation of using the inner door 200 and the outer door 100 with a configuration described above in accordance with the one embodiment of the present disclosure, as shown in FIG. 1, when the inner door 200 and the outer door 100 are closed, the refrigerating compartment 30 may be sealed and cool air in the refrigerating compartment 30 may be preserved.

As shown in FIG. 3, when the inner door 200 is closed and only the outer door 100 is opened, a user may approach the plurality of door guards 40 and may put food into or take food out of the plurality of door guards 40. In this case, loss of cool air in the refrigerating compartment 30 may be reduced compared to the case for an open inner door 200.

Also, since the control unit 700 is not installed in the storage compartment 20 or 30 but is installed in the inner door 200, when the inner door 200 is closed and only the outer door 100 is opened, the user may approach the control unit 700 and control the internal environments of the storage compartments 20 and 30. Here, loss of cool air in the refrigerating compartment 30 may also be reduced compared to the case for an open inner door 200.

As shown in FIG. 4, when the inner door 200 is open, the user may approach an inside of the refrigerating compartment 30 and put in or take out food stored on the racks 31. Here, the user may approach the plurality of door guards 40 and put food into or take food out of the plurality of door guards 40.

As described above, in the case of the refrigerator 1 in accordance with one embodiment of the present disclosure, food may be put in or taken out by various methods according to the user's need. Also, since only the outer door 100 is opened when food stored in the plurality of door guards 40 is put in or taken out, loss of cool air may be minimized.

In addition, since the door guards 40 of the refrigerator 1 in accordance with one embodiment of the present disclosure have enlarged storage spaces compared to conventional door guards, a diversity of options for storing food and an effect of reducing loss of cool air may be enhanced.

Also, since the control unit 700 is installed at the inner door 200 and is not visible when the outer door 100 is closed, the refrigerator 1 in accordance with one embodiment of the present disclosure may have a clean and aesthetic external appearance. Since only the outer door 100 needs to be opened to change internal environment settings of the storage compartments 20 and 30, the loss of cool air may be minimized. Also, the display portion 712 of the control unit 700 is turned on only when the outer door 100 is opened, thereby reducing power consumption.

Detailed configurations of the inner door 200, the outer door 100, and the control unit 700 of the refrigerator 1 in accordance with one embodiment of the present disclosure will be described below.

Figure 5:
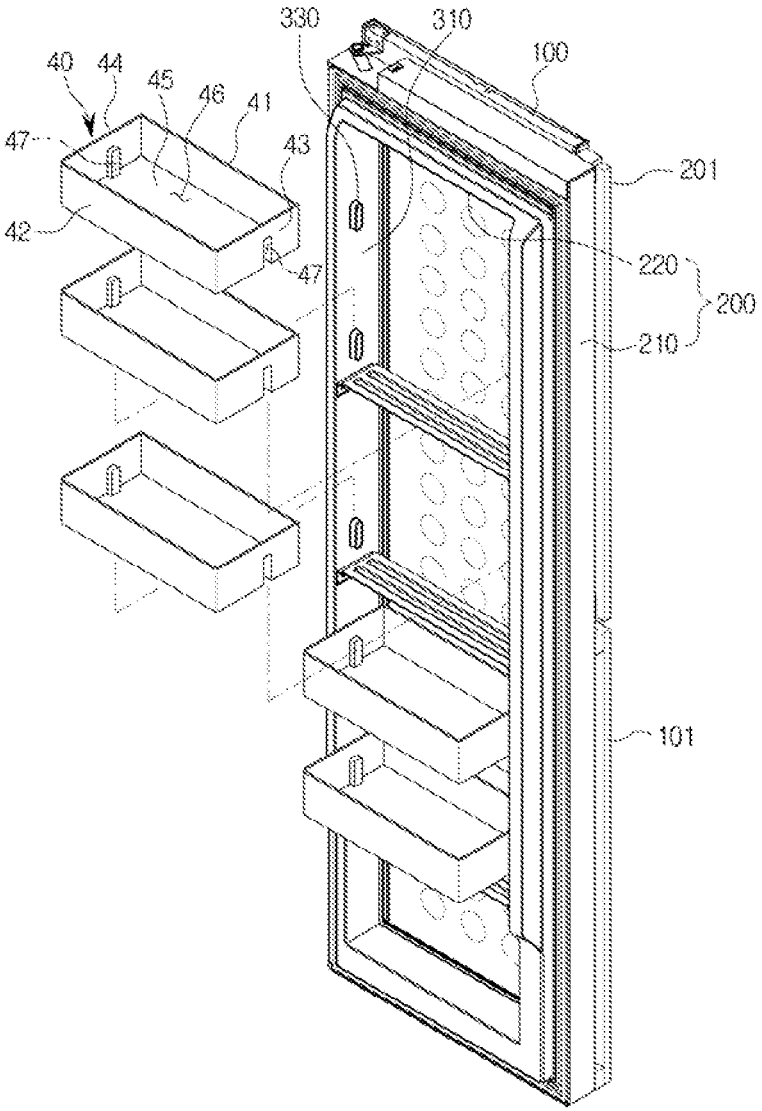
FIG. 5 is a view of the inner door and the door guards of the refrigerator of FIG. 1.
Figure 6:
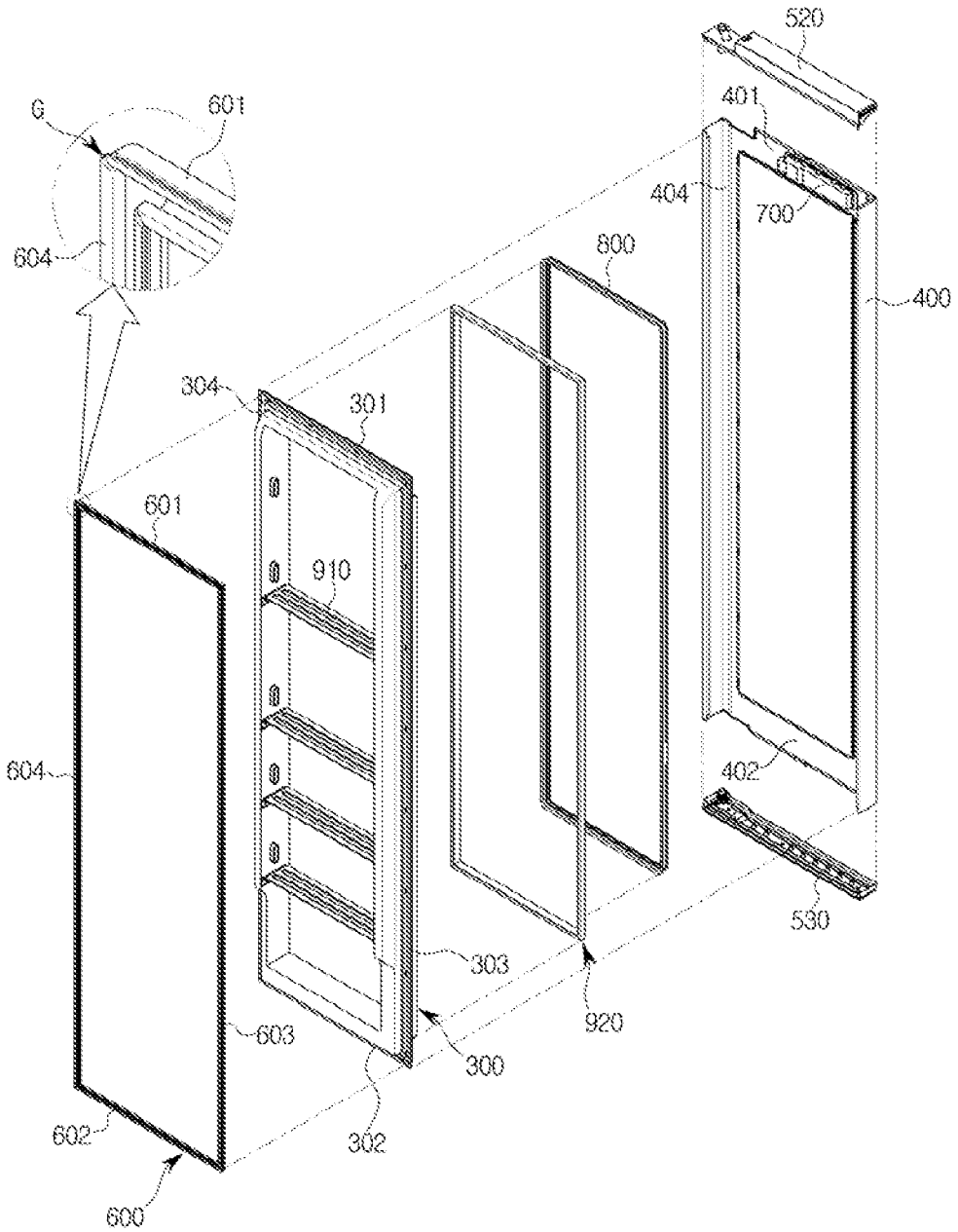
FIG. 6 is an exploded perspective view illustrating a configuration of the inner door of the refrigerator of FIG. 1.
Figure 7:
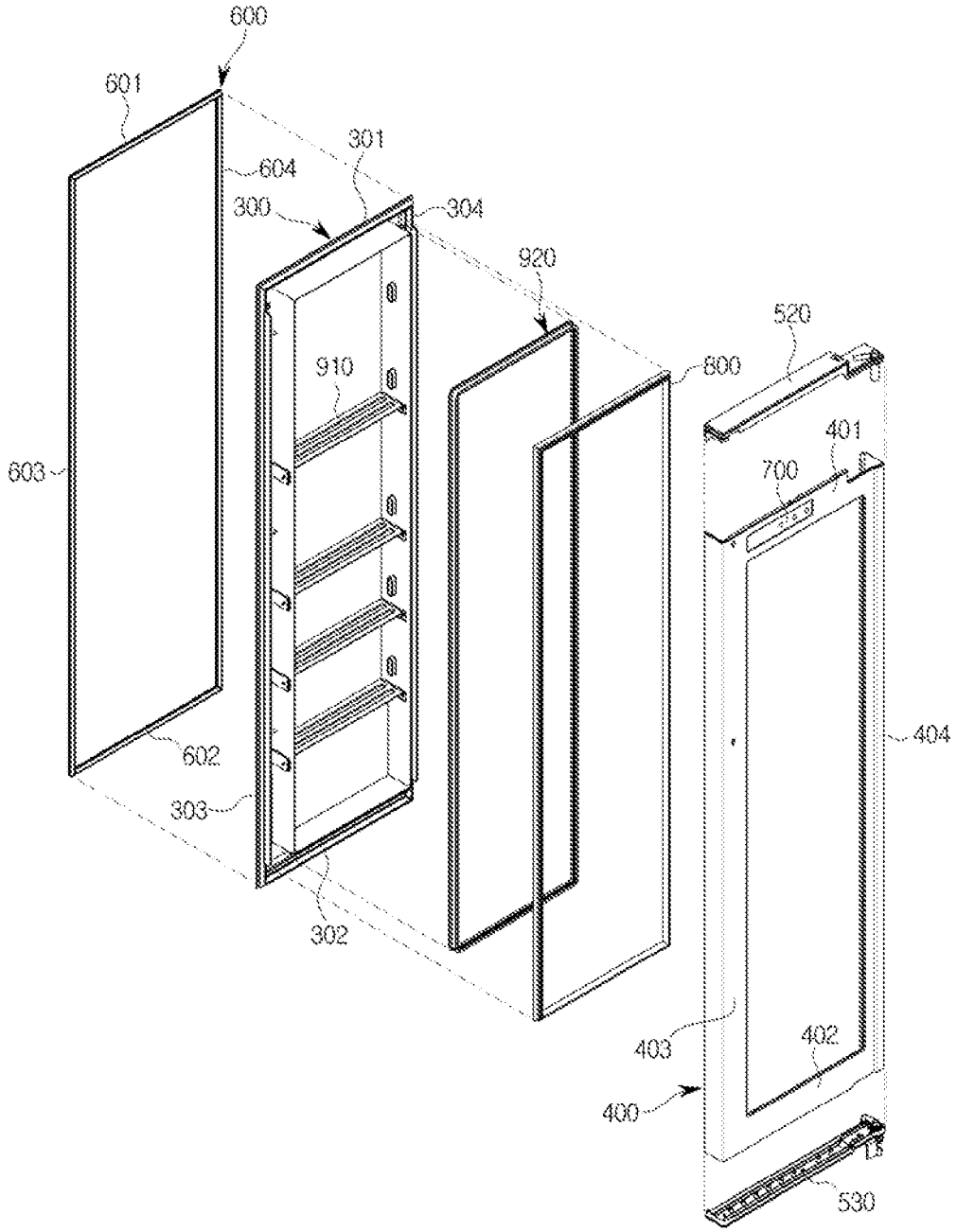
FIG. 7 is an exploded perspective view from a different angle illustrating the configuration of the inner door of the refrigerator of FIG. 1.
Figure 8:
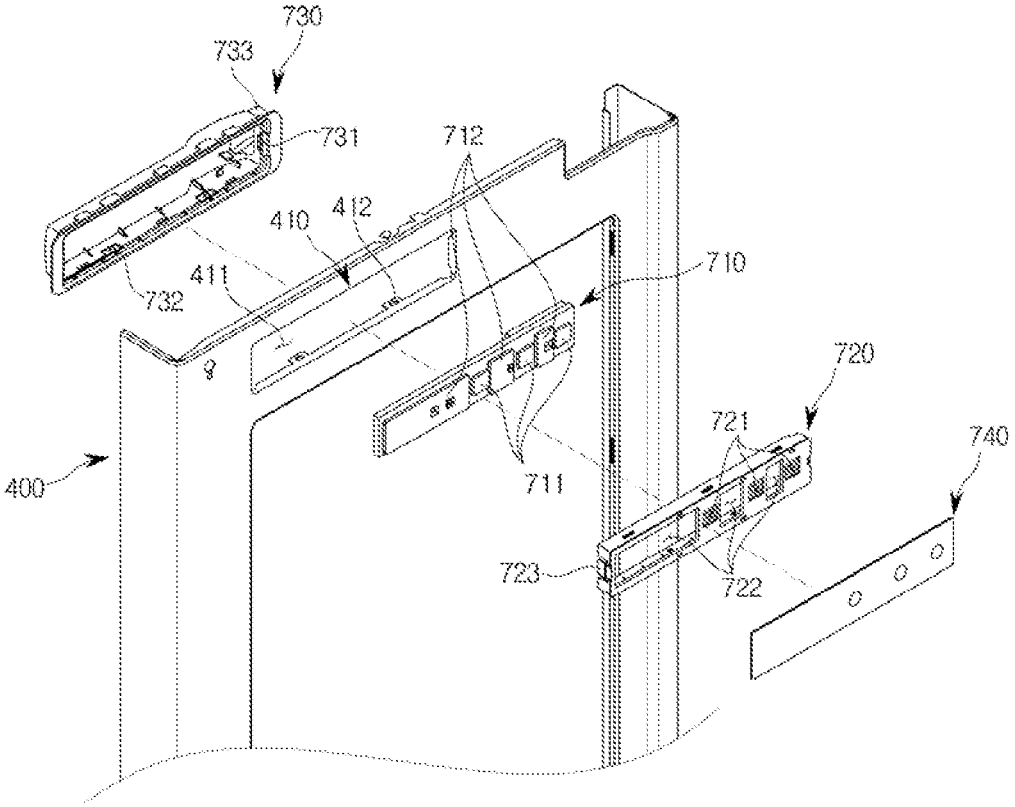
FIG. 8 is an exploded perspective view of a control unit disposed at the inner door of the refrigerator of FIG. 1.
Figure 9:
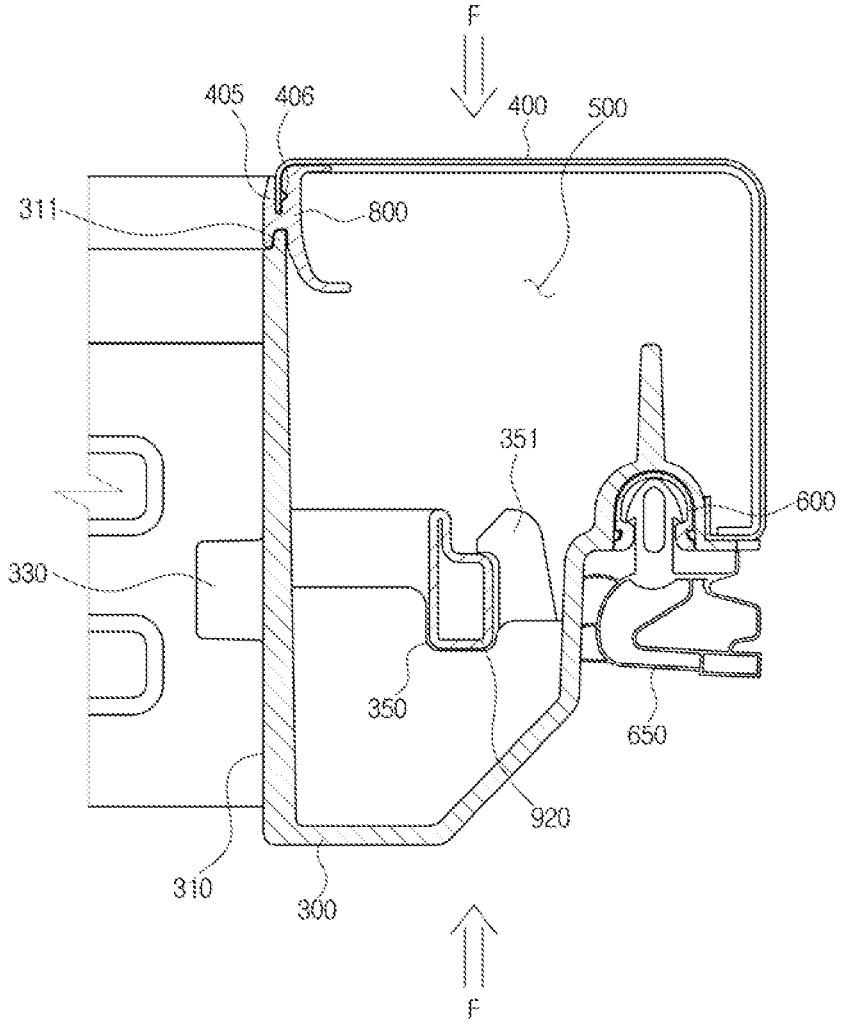
FIG. 9 is a partial cross-sectional view of the inner door of the refrigerator of FIG. 1.

FIG. 5 is a view of the inner door and the door guards of the refrigerator of FIG. 1, FIG. 6 is an exploded perspective view illustrating a configuration of the inner door of the refrigerator of FIG. 1, and FIG. 7 is an exploded perspective view from a different angle illustrating the configuration of the inner door of the refrigerator of FIG. 1. FIG. 8 is an exploded perspective view of a control unit disposed at the inner door of the refrigerator of FIG. 1, and FIG. 9 is a partial cross-sectional view of the inner door of the refrigerator of FIG. 1.

As is well shown in FIG. 5, the door guards 40 may have an approximately box shape. Accordingly, each of the door guards 40 may include a front wall 41, a rear wall 42, a left wall 43, a right wall 44, a bottom 45, and a storage space 46 which stores food. A supporting groove 47 may be formed at each of the left wall 43 and the right wall 44 of the door guard 40.

The inner door 200 may include an inner wall 310 provided at each sides of the opening 210 to support the door guard 40. A supporting protrusion 330 to be inserted into the supporting groove 47 of the door guard 40 may protrude from the inner wall 310.

Accordingly, the supporting protrusion 330 is inserted into the supporting groove 47, thereby the door guard 40 is mounted in the opening 210. The door guard 40 described above may be detached from the opening 210. Also, although not shown in the drawings, the door guard 40 may be provided to be slidable back and forth or up and down.

Meanwhile, as is well shown in FIG. 6, the inner door 200 may include an inner panel 300, an outer panel 400 coupled with the inner panel 300 between which a foam space 500 (refer to FIG. 9) interposes, a plurality of installation members 600 coupled with a rear side of the inner panel 300 at which a gasket 650 (refer to FIG. 9) is installed, a plurality of reinforcing members 910 and 920 which prevent a twisting of the inner door 200, and a door trim 800 coupled between an end portion of the inner panel 300 and an end portion of the outer panel 400 to prevent a bubble solution foamed at the foam space 500 from leaking outward.

The inner panel 300 may include an upper frame 301, a lower frame 302, a left frame 303, and a right frame 304 and may be formed of an integrally injection-molded resin material.

The outer panel 400 may be formed of a metal material and may include an upper frame 401, a lower frame 402, a left frame 403, and a right frame 404.

The inner panel 300 may include a pair of such inner walls 310 provided at both sides of the opening 210. The inner walls 310 may form the opening 210 and simultaneously may support the door guards 40.

Meanwhile, the door guards 40 may be disposed to be in contact with the outer door 100 of the opening 210 to allow the front wall 41 thereof to approximately form a part of a front side of the inner door 200.

By this structure, the door guards 40 may occupy the whole area of the opening 210, and a size thereof may be maximized. Also, since the door guards 40 are completely exposed when viewed from an outside of the inner door 200, a condition of food stored in the door guards 40 may be easily checked.

Meanwhile, as described above, the door guards 40 of the refrigerator 1 in accordance with one embodiment of the present disclosure may be provided at the opening 210 of the inner door 200 and may be not provided at a rear side of the outer door 100.

The outer door 100 may include an insulator provided between an inner panel 130 of the outer door 100 and an outer panel 120 of the outer door 100.

The inner panel 130 of the outer door 100 may be formed by vacuum-molding a resin material, and the outer panel 120 of the outer door 100 may include a metal material.

Meanwhile, the plurality of installation members 600 are for installing the gasket 650 at the inner panel 300 while minimizing use of a complicated mold including a slide core, etc. during an injection molding of the inner panel 300 and are coupled with a rear side rim of the inner panel 300.

The plurality of installation members 600, as is well shown in FIGS. 6 and 7, may include a first installation member 601 coupled with the upper frame 301 of the inner panel 300, a second installation member 602 coupled with the lower frame 302 of the inner panel 300, a third installation member 603 coupled with the left frame 303 of the inner panel 300, and a fourth installation member 604 coupled with the right frame 304 of the inner panel 300.

Here, the first installation member 601, the second installation member 602, the third installation member 603, and the fourth installation member 604 may be provided to be spaced apart rather than connected. Accordingly, the first installation member 601, the second installation member 602, the third installation member 603, and the fourth installation member 604 may be prevented from mutually interrupting by expansion due to heat.

As shown in FIG. 8, the control unit 700 may include a circuit board 710 which transmits a control signal according to an input of the user and displays internal environment information of the storage compartments 20 and 30. In detail, an operational portion 711 of the circuit board 710 may recognize the input of the user, and the display portion 712 may display the internal environment information of the storage compartments 20 and 30.

The circuit board 710 may further include a locking setting function for preventing a misoperation of the operational portion 711, a power-saving setting function for saving power of a refrigerator, etc. Recently, with the development of mobile communications, a wireless communication function capable of wirelessly operating settings of the refrigerator using a mobile device may be further included.

The circuit board 710 may be contained in a housing 730 and may be fixed by a cover 720. The cover 720 may include a coupling hook 723 for coupling with the housing 730, and the housing 730 may include a hook holding portion 731 for coupling with the coupling hook of the cover 720.

The cover 720 which covers the circuit board 710 of the control unit 700 may include a button portion 721 which operates on the operational portion 711 of the circuit board 710 and an opening 722 provided to expose the display portion 712. The user may input desired settings into the operational portion 7111 of the circuit board 710 by pressurizing the button portion 721. Since the display portion 712 of the circuit board 710 is exposed through the opening 722 of the cover 720, the user may check environment information displayed on the display portion 712 even when the circuit board 710 is covered with the cover 720.

The control unit 700 may be disposed in a space between the outer panel 400 and the inner panel 300 of the inner door 200 and may be mounted on the outer panel 400. The outer panel 400 of the inner door 200 may include the upper frame 401, the lower frame 402, the left frame 403, and the right frame 404, and at least one of among them may be provided with a mounting portion 410 for mounting the control unit 700.

The housing 730 of the control unit 700 may include a coupling hook 732 to be coupled with the mounting portion 410. The housing 730 may include a cable connecting portion 733 for connecting a cable to the circuit board 710 accommodated therein.

The mounting portion 410 may include a hook holding portion 412 capable of being coupled with the coupling hook 732 of the housing 730 and may include an opening 411 to expose the cover 720 of the control unit 700.

The control unit 700 may further include a transmission member (which may also be referred to as a transparent member) 740 for finishing of the cover 720. Since the transmission member 740 is an outermost component of the control unit 700, the transmission member 740 may not only have a function of preventing foreign substances from penetrating the control unit 700 but also an aesthetic function. Accordingly, not only a function of the button portion 721 corresponding to the button portion 721 of the cover 720 but also other elements of design may be printed on the transmission member 740.

The transmission member 740 may be formed of a material through which light shown on the display portion 712 of the circuit board 710 may pass and may be formed of a flexible resin material to pressurize the button portion 721. The transmission member 740 may include an adhesive layer formed on a rear side thereof to be adhered to the cover 720.

Meanwhile, the door trim 800 is for preventing the bubble solution in the foam space 500 between the inner panel 300 and the outer panel 400 from leaking outward. As shown in FIG. 9, the door trim 800 may include an insertion groove in which an end portion 311 of the inner wall 310 of the inner panel 300 is press fittingly inserted and an insertion groove in which an end portion 405 of the outer panel 400 is press fittingly inserted. Also, a coupling groove in which a coupling protrusion 406 of the outer panel 400 is inserted may be formed to reinforce a coupling force between the door trim 800 and the outer panel 400. A foaming process of the inner door 200 including the door trim 800 is as follows.

First, the control unit 700 is disposed at the mounting portion 410 of the outer panel 400. The housing 730 of the control unit 700 and the outer panel 400 are sealed not to allow the bubble solution to penetrate. Also, the cable connecting portion 733 provided to connect the cable to the circuit board 710 accommodated in the housing 730 may also be sealed.

Next, the inner panel 300, the outer panel 400, and the door trim 800 are preliminarily coupled, the inner panel 300 is disposed to face a bottom surface, and the outer panel 400 is disposed to face upward, and then the inner panel 300 and the outer panel 400 are pressurized in a vertical direction F using a fixing jig (not shown).

Then, the bubble solution is inserted into the foam space 500 formed between the inner panel 300 and the outer panel 400 for foaming. Here, since the inner panel 300 and the outer panel 400 are pressurized in the vertical direction F, the inner panel 300 and the outer panel 400 are not forced apart due to a foaming pressure in the vertical direction F. Accordingly, the bubble solution may not leak in the vertical direction.

Also, since the door trim 800 tightly holds the end portion of the inner panel 300 and the end portion of the outer panel 400, the inner panel 300 and the outer panel 400 are not forced apart by a foaming pressure in a horizontal direction, and the bubble solution may not leak.

Without the door trim 800, even though the inner panel 300 and the outer panel 400 next to the opening 210 are provided to overlap with each other, the bubble solution may leak through a gap formed due to a foaming pressure.

When foaming of the bubble solution for foaming in the foam space formed between the inner panel 300 and the outer panel 400 is completed, the inner panel 300, the outer panel 400, and the door trim 800 may be strongly coupled and the control unit 700 may also be strongly coupled with the outer panel 400 by an adhesive force of the bubble solution.

Meanwhile, the inner door 200 of the refrigerator 1 in accordance with one embodiment of the present disclosure is vulnerable to a twisting due to the opening 210. Also, a twisting may occur or the inner wall 310 may be not formed even due to a foaming pressure in a foaming process of the inner door 200. The plurality of reinforcing members 910 and 920 may be provided at the inner door 200 to overcome the above described vulnerability.

The plurality of reinforcing members 910 and 920 may include a first reinforcing member 910 which crosses the opening 210 and connects the left frame 303 of the inner panel 300 with the right frame 304 of the inner panel 300 and a second reinforcing member 920 provided at the upper frame 301 of the inner panel 300, the lower frame 302 of the inner panel 300, the left frame 303 of the inner panel 300, and the right frame 304 of the inner panel 300.

The second reinforcing member 920 may include an upper reinforcing portion 921, a lower reinforcing portion 922, a left reinforcing portion 923, and a right reinforcing portion 924 and may be provided in an approximate quadrangular frame shape. The second reinforcing member 920 may be integrally formed of a metal material having hardness.

As shown in FIG. 9, an accommodating space 350 which accommodates the second reinforcing member 920 and the hook portion 351 which fixes the second reinforcing member 920 may be formed at the inner panel 300. Accordingly, the second reinforcing member 920 may be coupled with the inner panel 300 and may be disposed between the inner panel 300 and the outer panel 400. Accordingly, the second reinforcing member 920 may be not exposed to the outside.

The second reinforcing member 920 may be fixed to the inner panel 300 before the bubble solution is foamed in the foam space formed between the inner panel 300 and the outer panel 400.

The first reinforcing member 910 prevents the twisting of the inner door 200 by directly connecting the relatively long left frame 303 of the inner panel 300 and the right frame 304 of the inner panel 300 across the opening 210. The second reinforcing member 920 is provided at each of the upper frame 301 of the inner panel 300, the lower frame 302 of the inner panel 300, the left frame 303 of the inner panel 300, and the right frame 304 of the inner panel 300 to reinforce four sides, thereby preventing the twisting of the inner door 200.

However, although both the first reinforcing member 910 and the second reinforcing member 920 are provided in the embodiment of the present disclosure, only one of the first reinforcing member 910 and the second reinforcing member 920 may be provided as necessary.

Figure 10:
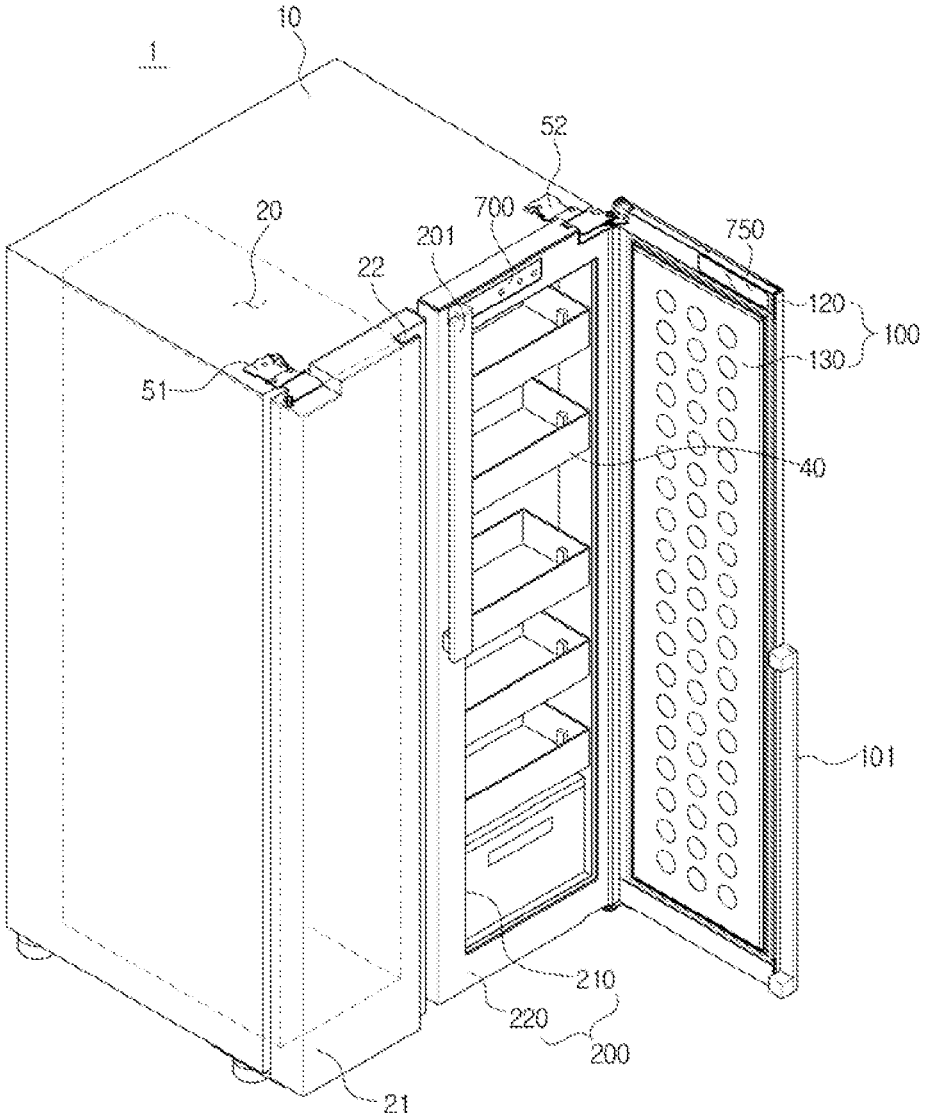
FIG. 10 is a view of a refrigerator in accordance with another embodiment of the present disclosure in which a transparent window is provided at the outer door.

FIG. 10 is a view of a refrigerator in accordance with another embodiment of the present disclosure in which a transparent window is provided at the outer door.

Referring to FIG. 10, a transparent window 750 may be provided at the outer door 100 of the refrigerator 1 for checking the display portion 712 of the control unit 700 with the outer door 100 closed. With the outer door 100 closed, the transparent window 750 is provided at a position corresponding to a position of the control unit 700 disposed at the inner door 200. The transparent window 750 is provided to be through both the outer panel 120 and the inner panel 130 of the outer door 100.

When the control unit 700 is manufactured using an electrostatic touch panel, the transparent window 759 may be formed of a conductive material for operating the control unit 700 even with the outer door 100 closed.

Figure 11:
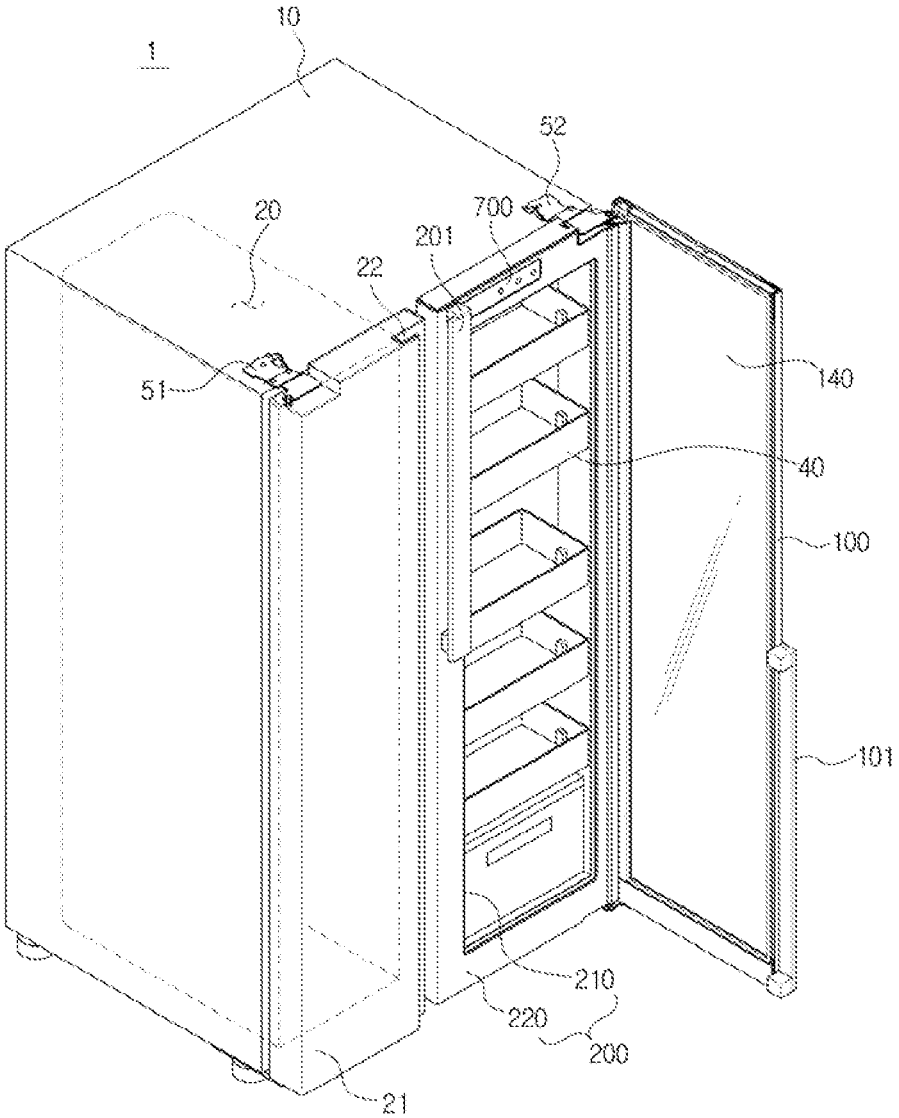
FIG. 11 is a view of a refrigerator in accordance with still another embodiment of the present disclosure in which an outer door is totally formed with a transparent window.

FIG. 11 is a view of a refrigerator in accordance with still another embodiment of the present disclosure in which an outer door is totally formed with a transparent window.

Referring to FIG. 11, the outer door 100 may be formed of a transparent or translucent material to check not only the control unit 700 but also an inside of the refrigerating compartment 30 with the outer door 100 closed. As shown in FIG. 11, the entire outer door 100 may be formed of the transparent or translucent material, or a part of the outer door 100 may be formed of the transparent or translucent material.

In detail, both the outer panel 120 and the inner panel 130 of the outer door 100 may be formed of a transparent or translucent panel 140 including a glass material, etc. and an insulating layer including an air layer, etc. may be included between panels. Also, there may be formed a single transparent panel 140.

When the control unit 700 is manufactured using an electrostatic touch panel, the transparent panel 140 may be formed of a conductive material for operating the control unit 700 even with the outer door 100 closed.

As is apparent from the above description, since a control unit is provided at an inner door of a dual door, a misoperation of a user may be prevented and contaminations caused by external foreign substances, etc. may be prevented. Also, since the control unit is operated by opening only an outer door of the dual door while the inner door is closed, it is possible to reduce thermal loss of a storage compartment while the control unit is operated. Also, by having the outer door be formed overall as a transparent window or providing a transparent window which allows displaying a portion of the control unit of the inner door for externally checking, environment setting condition of the storage compartment may be checked without opening the outer door.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A refrigerator comprising:

a body;

a storage compartment formed in the body;

a first door pivotably coupled with the body and comprising a frame forming an opening, and a mounting portion on the frame;

a door basket mounted to the first door, and on which food is storable;

a control unit mounted on the mounting portion, and including a display portion to display information of the storage compartment; and a second door pivotable with respect to the first door and including a transparent or translucent portion, wherein the first door and the second door are configured so that, while the first door and the second door are closed, the door basket is visible to a user through the transparent or translucent portion and the opening, and the display portion is visible to the user through the transparent or translucent portion, and in response to the first door being opened while the second door is closed, the first door, the second door, and the control unit move together.

2. The refrigerator of claim 1, wherein the control unit comprises:

a circuit board including an operational portion; and a housing that houses the circuit board and is coupled with the mounting portion.

3. The refrigerator of claim 2, wherein the control unit comprises a cover covering the circuit board, the cover comprising a button portion for user input to the operational portion.

4. The refrigerator of claim 1, wherein the transparent or translucent portion is provided to allow the food stored in the door basket to be visible to the user.

5. The refrigerator of claim 1, wherein the control unit is configured to control at least one of a temperature, humidity, smell, and lighting of the storage compartment in accordance with a received user input.

6. The refrigerator of claim 1, wherein the frame comprises an upper frame, a lower frame, a left frame, and a right frame which form the opening, and the mounting portion is on at least one of the upper frame, the lower frame, the left frame, and the right frame.

7. The refrigerator of claim 1, wherein the first door comprises an inner panel, an outer panel forming an interposing space with the inner panel, and an insulator foamed in the interposing space, and the control unit is disposed between the inner panel and the outer panel.

8. The refrigerator of claim 3, wherein the housing comprises a wire connecting portion to connect a wire to the circuit board.

* * * * *